US007191893B2

(12) United States Patent
Maldina et al.

(10) Patent No.: US 7,191,893 B2
(45) Date of Patent: Mar. 20, 2007

(54) UNIT FOR TRANSFERRING AND SPACING ARTICLES

(75) Inventors: Lorenzo Maldina, Bologna (IT); Giancarlo Tedeschi, Gallo Bolognese di Castel S. Pietro (IT); Antonio Orillo, Casalecchio Di Reno (IT)

(73) Assignee: I.M.A. Industria Macchine Automatiche S.p.A., Ozzano Emilia (IT)

( * ) Notice: Subject to any disclaimer, the term of this patent is extended or adjusted under 35 U.S.C. 154(b) by 0 days.

(21) Appl. No.: 10/533,273

(22) PCT Filed: Oct. 28, 2003

(86) PCT No.: PCT/IB03/04772

§ 371 (c)(1),
(2), (4) Date: Jul. 14, 2005

(87) PCT Pub. No.: WO2004/039707

PCT Pub. Date: May 13, 2004

(65) Prior Publication Data

US 2006/0051186 A1 Mar. 9, 2006

(30) Foreign Application Priority Data

Oct. 30, 2002 (IT) ..... BO2002A0679

(51) Int. Cl.
*B65G 47/32* (2006.01)

(52) U.S. Cl. ..... 198/418.6; 198/458; 198/459.1

(58) Field of Classification Search ..... 198/458, 198/459.1, 459.5, 459.6, 550.2, 418.6, 563, 198/708; 53/539, 158, 248, 250, 251, 263
See application file for complete search history.

(56) References Cited

U.S. PATENT DOCUMENTS 3,561,189 A * 2/1971 Raudat ..... 53/497

(Continued)

FOREIGN PATENT DOCUMENTS

EP 0 440 848 A1 8/1991

(Continued)

*Primary Examiner*—Douglas A. Hess
(74) *Attorney, Agent, or Firm*—William J. Sapone; Coleman Sudol Sapone PC

(57) ABSTRACT

A unit (1) for transferring articles (1*a*) from a machine (MI) for producing the articles to a packaging machine (MA) includes a plurality of hoppers (4*a*) for receiving the articles (1*a*). The hoppers (4*a*) are situated between an outlet station (3) of the producing machine (MI) and an inlet station (6) of the packaging machine (MA). The hoppers (4*a*) are arranged at a variable distance from one another and move alternatively between a first working configuration (A), in which the hoppers (4*a*) are moved closer to each other, in order to be situated in the region of, and in registry with, an outlet station (3) of the producing machine (MI), so as to receive the articles (1*a*), and a second working configuration (B), in which the hoppers (4*a*) are moved far from each other, in order to be situated in the region of, and in registry with, an inlet station (6) of the packaging machine (MA), so as to transfer the articles (1*a*) to the inlet station (6).

3 Claims, 5 Drawing Sheets

U.S. PATENT DOCUMENTS 3,581,870 A * 6/1971 Best ..... 53/500
3,690,438 A * 9/1972 Goodman et al. ..... 198/418.1
3,964,233 A 6/1976 Thomas
4,457,121 A * 7/1984 Johnson et al. ..... 53/56
4,525,985 A * 7/1985 Sammens ..... 53/497
4,552,262 A * 11/1985 Murakami et al. ..... 198/447
4,603,772 A * 8/1986 Tomosue ..... 198/418.6
4,771,876 A * 9/1988 Bandixen ..... 198/367
4,864,798 A * 9/1989 Gies et al. ..... 53/202
5,150,563 A * 9/1992 Hartness ..... 53/539
5,335,482 A * 8/1994 Kinigakis et al. ..... 53/448
5,343,671 A * 9/1994 Tisma ..... 53/437
5,353,913 A * 10/1994 Steiger et al. ..... 198/418.6
5,450,941 A * 9/1995 Loewenthal ..... 198/418.5
5,477,655 A * 12/1995 Hawley ..... 53/251
5,638,938 A * 6/1997 Lazzarotti et al. ..... 198/445
5,653,328 A * 8/1997 Pedrotto ..... 198/418.1
5,797,249 A * 8/1998 Hartness ..... 53/473
5,918,726 A * 7/1999 Temmink ..... 198/418.6
6,065,586 A 5/2000 Heinz
6,360,871 B1 * 3/2002 Meyer et al. ..... 198/419.1
6,625,960 B1 * 9/2003 Nambu ..... 53/502
6,776,278 B1 * 8/2004 Gross et al. ..... 198/416
6,811,017 B1 * 11/2004 Gross et al. ..... 198/453
6,895,730 B2 * 5/2005 Weaver et al. ..... 53/500

FOREIGN PATENT DOCUMENTS

JP 59190110 10/1984

* cited by examiner

UNIT FOR TRANSFERRING AND SPACING ARTICLES

FIELD OF THE INVENTION

The present invention relates to a unit for transferring articles from a producing machine to a packaging machine.

In particular, the present invention is used during the manufacturing of articles employed in food production field and during the packaging of the articles into relative boxes and/or cases and/or cartons.

BACKGROUND OF THE INVENTION

The following description will refer explicitly to the production and packaging of the above articles, without losing its general character.

There are manufacturing or in-bagging machines, which fabricate welded tubular wrappings or bags of the type known as flow-pack, containing granular substances therein.

More in detail, the in-bagging machines produce bags beginning from a continuous sheet, of e.g. heat-weldable paper, which is preliminarily cut, so as to define a plurality of strips, vertically parallel.

Afterwards, each of the strips is brought to a tubular configuration by suitable folding means and then welded longitudinally along the edges.

In step relation with the longitudinal welding, the bottom of each vertical strip is also welded and afterwards, a measured quantity of the predetermined granular or powder substance is filled into the flow-pack.

When the filling is completed, each strip is welded again at top and cut near the median line of the welded portion, so as to detach it from the continuous sheet and to define the bottom of a subsequent tubular structure.

The so obtained sealed tubular bags, usually arranged one beside another in longitudinal vertical configuration, are withdrawn at the outlet portion of the in-bagging machine by suitable withdrawing and transferring means (for example by conventional suction means known as "pick and place"), and later fed, arranged longitudinally horizontally, to corresponding hoppers of an outlet station of the bag filling machine.

After the bags have been placed in the hoppers, the bottom of the hoppers are opened, so that the tubular bags are released to fall into corresponding boxes of a box conveyor, which constitutes an inlet portion of a packaging machine, aimed at packaging groups of bags into cases.

In order to ensure best and efficient transferring of the sealed tubular bags from the bagging machine to the packaging machine, the distance between the axes of two consecutive hoppers, or step, must be substantially equal to the corresponding step of the box-compartments of the packaging machine conveyor.

In this way, a correct filling of the conveyor box-compartments with a predetermined number of tubular bags is ensured.

Therefore, according to the above described known method, when the size of the tubular bags is changed, that is when one wants to produce tubular bags of different transverse dimensions, the step between the above hoppers, i.e. the distance between the hoppers, must be changed, and consequently, the step or distance between different box-compartments of the packaging machine conveyor must be adjusted and changed.

As it is easily understood, such changes result in difficult and complicated adjustment work, which causes long down-times.

SUMMARY OF THE INVENTION

The object of the present invention is to overcome the drawbacks and solve the problems of the above described prior art.

According to the present invention, a unit is manufactured for transferring articles from a producing machine to a packaging machine, and is characterized in that it includes a plurality of means for receiving said articles, said receiving means being situated between an outlet station of said producing machine and an inlet station of said packaging machine; said receiving means being arranged at a variable distance from one another and moving alternatively between a first working configuration, in which the receiving means are moved closer to each other, in order to be situated in the region of, and in registry with, said outlet station of the producing machine, so as to receive said articles, and a second working configuration, in which the receiving means are moved far from each other, in order to be situated in the region of, and in registry with, said inlet station of the packaging machine, so as to transfer the articles to the inlet station.

BRIEF DESCRIPTION OF THE DRAWINGS

The characteristic features of the invention will be pointed out in the following description of a preferred, but not only embodiment, with particular reference to the enclosed figures, in which.

DESCRIPTION OF THE PREFERRED EMBODIMENTS

Figure 1:
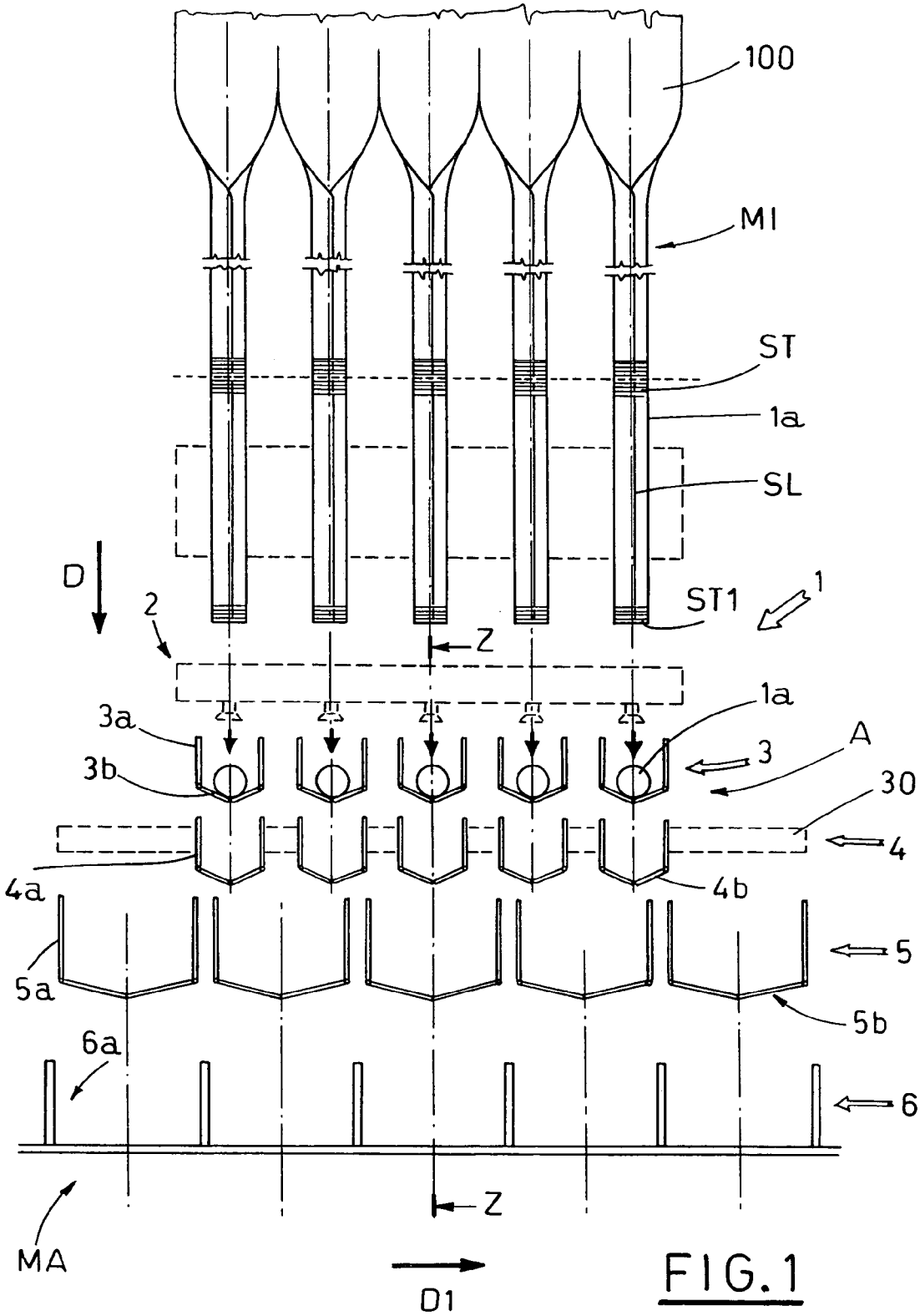
FIG. 1 is a schematic front, partially sectional view of a preferred embodiment of the transferring unit proposed by the present invention, with some parts removed for sake of clarity.

With reference to FIG. 1, the reference number 1 indicates a unit for transferring tubular bags 1*a* from a bagging machine MI to an inlet station 6, defined by a conveyor 6, of a packaging machine MA.

Each of the bags 1*a* contains preferably a granular or in-powder product (not shown). The bags are produced in a known way by the machine MI, beginning from a continuous sheet of a wrapping material 100. The wrapping material is cut or scored and closed with a longitudinal welding line SL and two crosswise welding lines ST and ST1 at the opposite ends of the so formed bag 1*a*. This kind of bag is known as the flow-pack.

According to FIG. 1, the bagging machine MI includes pickup means 2 which pick up, according to known technique, groups of tubular bags 1*a* arranged vertically, that is with the longitudinal welding lines SL arranged vertically parallel to a vertical direction D of the FIG. 1.

The pick up means drop the groups of tubular bags in horizontal configuration, that is with the longitudinal welding lines SL arranged horizontally and crosswise to the direction D, into a plurality of discharge buckets 3*a* of an outlet station s of the bag producing machine MI.

The discharge buckets 3*a* are preferably defined by hoppers 3*a*. The bottom ends 3*b* of the hoppers can be opened and are arranged at a fixed distance one from the other, as a function of the size of the tubular bags 1*a*, in particular of the transverse dimension of the bags 1*a*.

The unit 1, proposed by the present invention, includes a conveying line 4, situated downstream of the outlet station 3 of the bag making machine MI and equipped with a plurality of mobile buckets 4*a*. The distances between the axes of the mobile buckets, or step, can be varied.

A terminal line 5, situated in cascade with respect to the direction D, includes a plurality of terminal buckets 5*a*, arranged at fixed distances from one another and facing, each one, a relative box-compartment 6*a* of the inlet conveyor 6 of the packaging machine MA.

According to Figures from 1 to 5, the mobile buckets 4*a* are preferably defined by hoppers 4*a*; the bottom ends 4*b* of the mobile buckets can be opened. In operation, the distance between the axes of the mobile buckets 4*a* is changed from a receiving configuration A, in which the buckets 4*a* are situated each one below, and in registry with a relevant discharge hopper 3*a*, in order to receive the tubular bags 1*a* falling from the bottoms 3*b* (FIG. 2) being opened, to a release configuration B, in which each bucket 4*a* is situated above, and in registry with a relevant terminal bucket 5*a*, in order to drop the tubular bags 1*a* into the buckets 5*a*.

In order to allow the variable distance configuration of the hoppers 4*a* of the line 4, the hoppers 4*a* are slidably mounted on guides 30 (shown with broken line in FIGS. from 1 to 5), and are moved by motors, known and not shown, for example brush-less motors, so as to define and realize an alternate expansion/compression or pantographic movement.

More in detail, the mobile hoppers 4*a* are moved alternately far from and close to one another in relation to a plane Z substantially orthogonal to the working line 4 and to a movement direction Dl of the conveyor 6 (FIG. 1).

Still according to the enclosed figures, the buckets 5*a* of the terminal line 5 are likewise preferably defined by hoppers 5*a* having bottom ends 5*b*, which can be opened, and situated at a fixed distance from one another.

The distance can be suitably adjusted in relation to the size of the box compartments 6*a* of the conveyor 6, however independently from the size of the tubular bags 1*a*.

In particular, the distances between the axes of the hoppers 4*a* in the receiving configuration A are equal to the distances between the axes of the discharge hoppers 3*a*, situated above, and likewise, the distance between the axes of each pair of adjacent hoppers 4*a* in the release configuration B is preferably equal to the distance or step between the axes of the pairs of terminal hoppers 5*a*, situated below.

Figure 2:
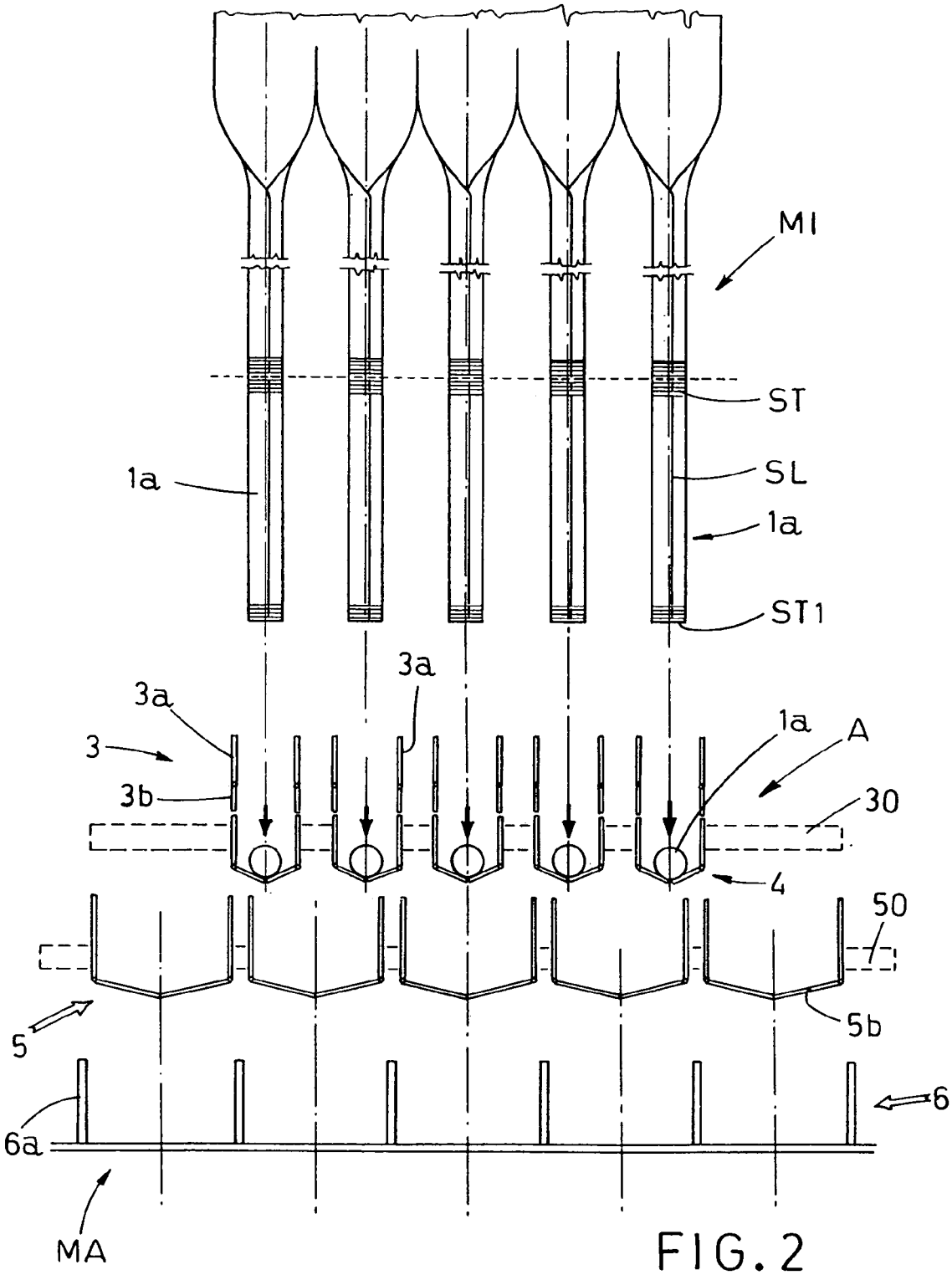
FIGS. 2, 3, 4 and 5 are front views of the same unit of FIG. 1 in different and subsequent working positions.

According to FIG. 2, in case the conveyor 6 of the machine MA is moved stepwise, the terminal hoppers 5*a* of the terminal line 5 can mounted on a support 50 (shown with broken line in FIG. 2), stationary with respect to the outlet station 3 of the bag making machine MI.

Otherwise, if the conveyor 6, equipped with box compartments 6*a*, moves continuously, the correct drop of the tubular bags 1*a* into the box compartments 6*a* is ensured by mounting the terminal hoppers 5*a* on a movable support 50, e.g. of the known follow-type, sliding with respect to the outlet station 3, in step relation with and at the same speed as the conveyor 6.

The operation of the unit 1 will be described in the following with reference to an operation step, in which the pickup means 2 have already dropped single bags 1*a*, in horizontal configuration, into each discharge hopper 3*a*.

In time relation with the drop of one tubular bag 1*a* into each discharge hopper 3*a*, the mobile hoppers 4*a* are moved to the receiving configuration A by compacting them slidingly along the guides 30, (FIG. 1). In this configuration, the bottoms 3*b* of the hoppers 3*a* open, so as to make the bags 1*a* fall directly into the hoppers 4*a* (FIG. 2).

Figure 3:
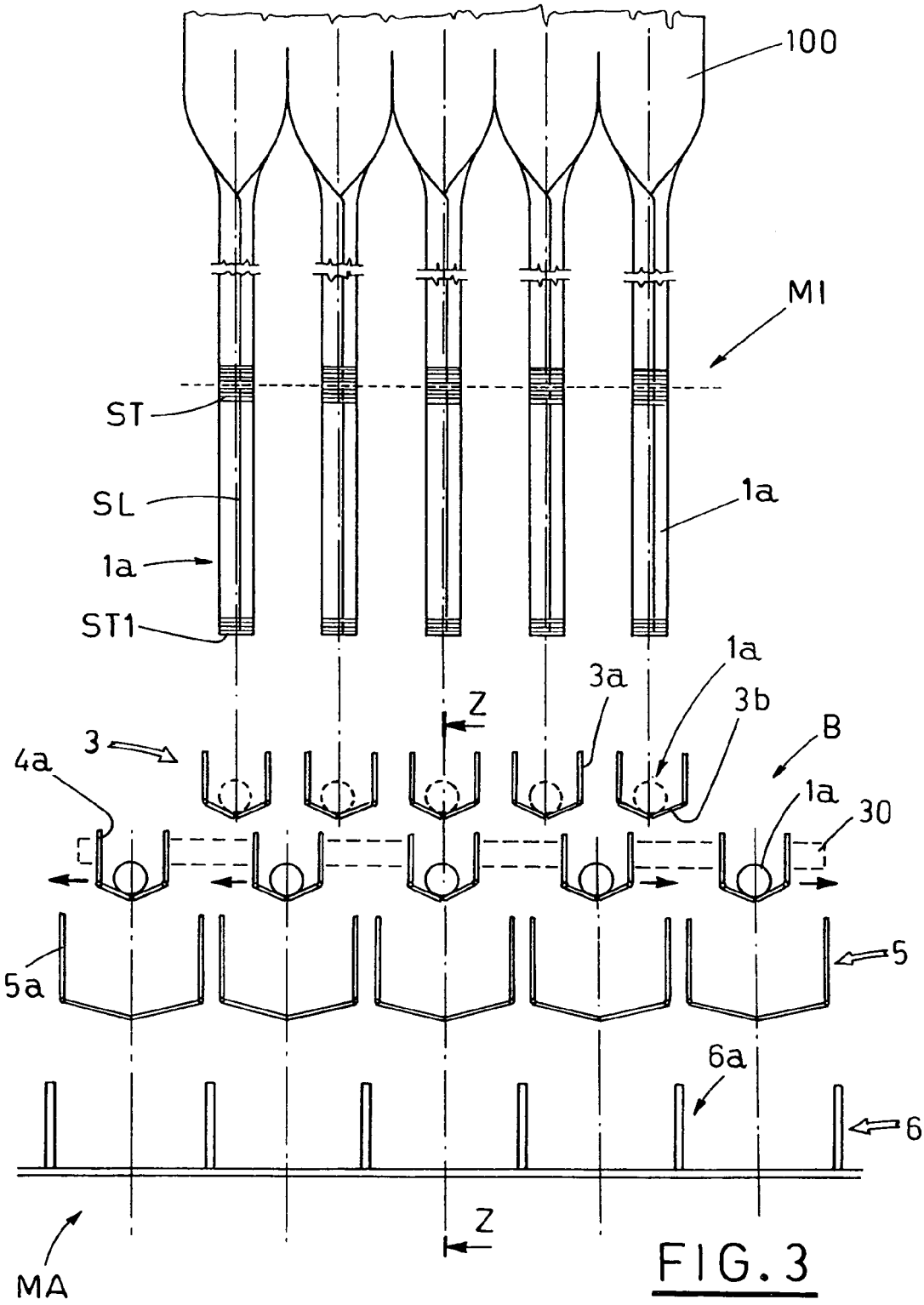
Figure 4:
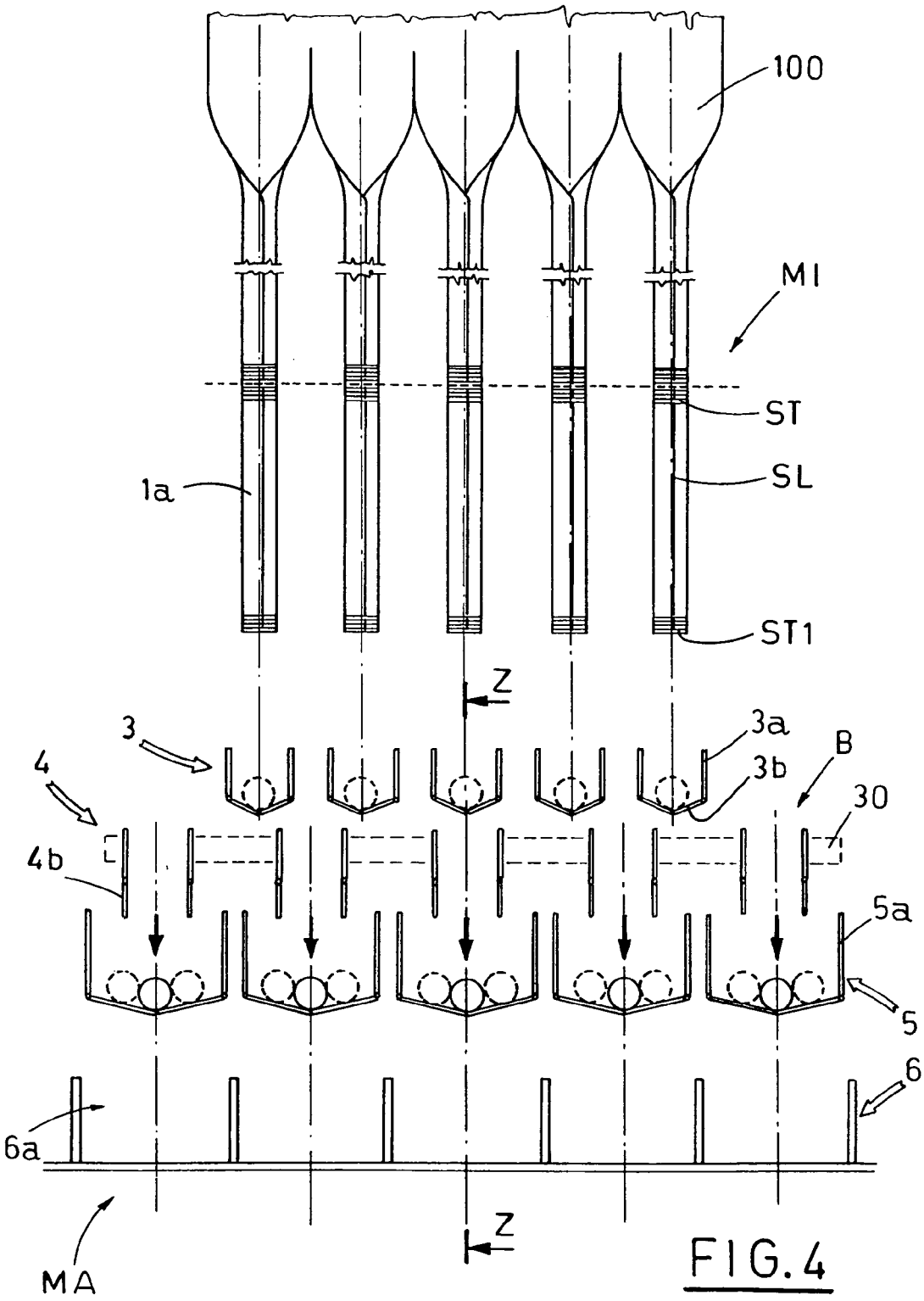

At this point, the hoppers 4*a* are moved in relative expansion along the guide 30 up to the release configuration B (FIG. 3), so as to be arranged exactly above the terminal hoppers 5*a* of the terminal line 5, and in such a way that, when the respective bottom ends 4*b* open, the bags 1*a* situated inside the hoppers 4*a* are free to fall into the respective terminal hoppers 5*a* (FIG. 4).

As it is better seen in FIG. 3, as soon as the tubular bags 1*a* are released from the outlet station 3 to the hoppers 4*a*, the discharge hoppers 3*a* are ready to receive subsequent bags 1*a* produced continuously by the bag machine MI.

Figure 5:
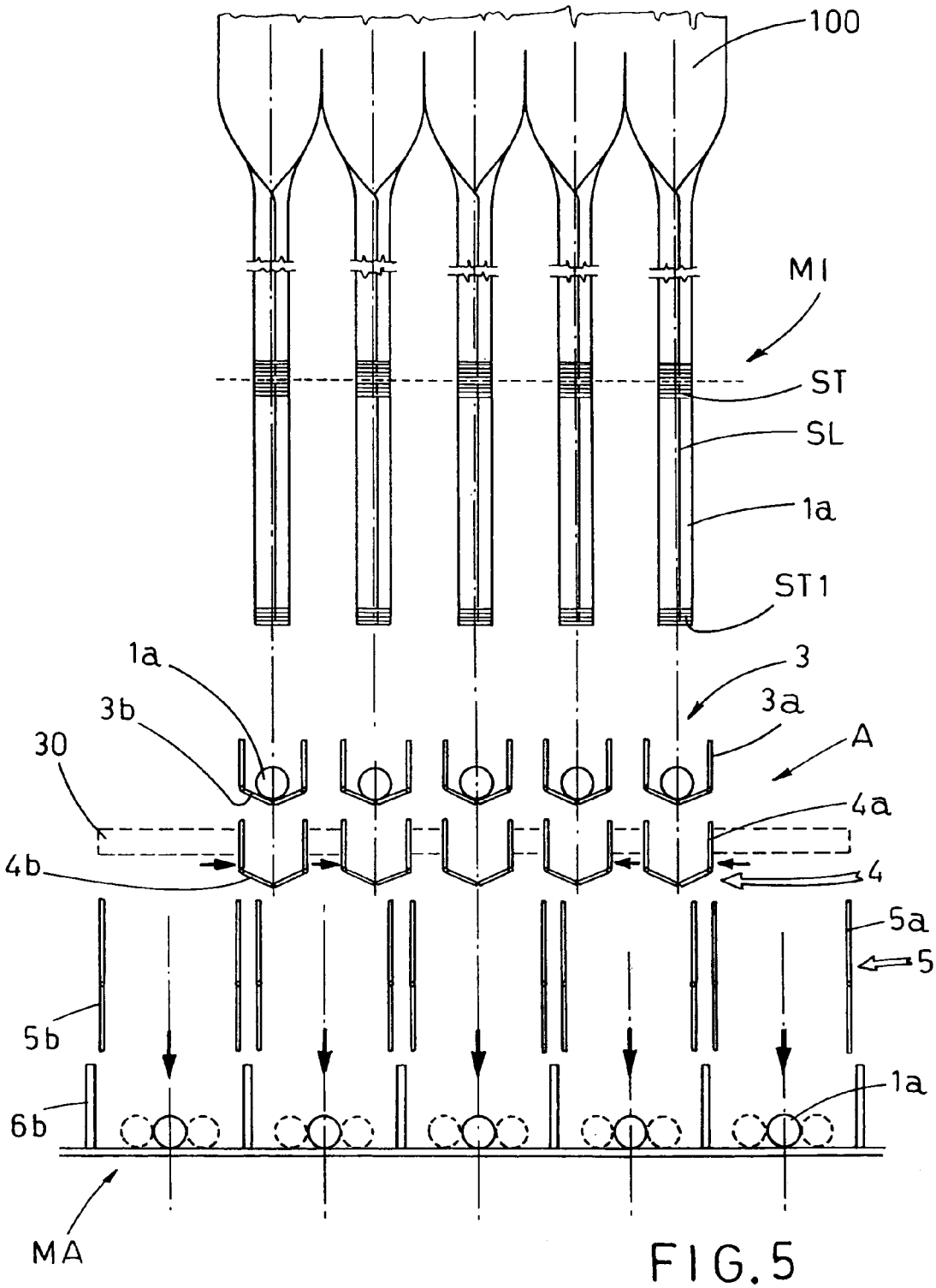

Likewise, as soon as the mobile hoppers 4*a* drop the tubular bags 1*a*, the same hoppers 4*a* are moved again, with a compression movement, to the receiving configuration A, waiting for tubular bags 1*a*, which will be released from the discharge hoppers 3*a* (FIG. 5), according to a continuous repetition of the production cycle.

When the bags 1*a* have reached the hoppers 5*a*, the bottoms 5*b* of the terminal hoppers 5*a* are opened, so that the bags fill the box-compartments 6*a* of the packaging machine MA conveyor 6.

In case the conveyor 6 is operated in a continuous motion, as soon as a predetermined number of tubular bags 1*a* are collected within each one of the terminal hoppers 5*a*, the moving support 50 is first driven so as to follow the box-compartments 6*a*, into which the hoppers 5*a* can release the bags 1*a*, and then it is made return with a backward motion up to a position corresponding to the release configuration B of the mobile hoppers 4*a*.

In the last case, the tubular bags 1*a* are released into to boxes 6*a* is obtained by keeping the terminal hoppers 5*a* in registry with the boxes 6*a*.

The so described unit 1 is used without substantial changes to transfer tubular bags 1*a* of different dimensions from the machine MI to the machine MA.

In fact, it is enough to adjust, by a simple operation, only the respective strokes which the mobile hoppers 4*a* run during the passage from the receiving configuration A, in which they are situated below the discharge hoppers 3*a*, to the release configuration B, in which they are situated above the terminal hoppers 5*a*.

Therefore, the proposed unit 1 allows quick and simple change-over operation, when the size of the articles being packaged is changed, thus reducing substantially the downtimes and therefore increasing the overall production rate.

In particular, according to the preferred embodiment, there are provided five mobile hoppers 4*a*, (that is an odd number of hoppers) and therefore, the central hopper 4*a* remains stationary, while the lateral hoppers are moved, so as to be set in registry either with the discharge hoppers 3*a* or with the terminal hoppers 5*a*, whichever is the case in accordance with the operation step.

The terminal hoppers 5*a* have suitable dimensions, which allow to release into the box-compartments 6*a*, underlying the terminal hoppers 5*a*, a number of tubular bags 1*a*, which varies within a wide range.

It is also to be pointed out that in this case, each group of hoppers 3*a*, 4*a* and 5*a* (discharge, mobile for transferring and terminal) when considered in vertical, feed a selected series of boxes 6*a*. Therefore, it is particularly easy to detect and correct possible wrong operation, for instance when an incorrect number of bags is contained in a box-compartment or the total weight of the bags contained in a box-compartment does not match the expected value. The verify can be easily performed by checking the cases packaged in the packaging machine MA and the correction can be effected directly upstream of the machine MA, acting on the vertical group of hoppers through which the bags are transferred from the machine MI to the machine MA.

Likewise, it is possible to perform a verify also in the case when faults and/or problems on a defined vertical group of hoppers are found, thus being possible to reject only packs containing the bags fed and transferred by this vertical group of hoppers.

According to alternative variants (not shown), it is possible to provide only one working line, e.g. conveying line 4, which can receive tubular bags 1*a* from the outlet station 3 of the bag making machine MI and can position them directly into the boxes of the conveyor 6 of the machine MA, without interposing the terminal line 5.

According to still another variant of the proposed transferring unit 1, the working line 4 receives articles directly from the withdrawing means 2 connected to the bag making machine MI, that is without interposing the discharge hoppers 3*a*.

The invention claimed is:

1. A unit (1) for transferring articles (1) from a machine (MI) for producing these articles to a packaging machine (MA), the unit including:

a plurality of means (4*a*) for receiving said articles (1*a*), said receiving means (4*a*) being situated between an outlet station (3) of said producing machine (MI) and an inlet station (6) of said packaging machine (MA);

said receiving means (4*a*) being arranged at a variable distance from one another and moving alternatively between a first working configuration (A), in which the receiving means (4*a*) are moved closer to each other, in order to be situated in the region of, and in registry with, said outlet station (3) of the producing machine (MI), so as to receive said articles (1*a*), and a second working configuration (B), in which the receiving means (4*a*) are moved far from each other, in order to be situated in the region of, and in registry with, said inlet station (6) of the packaging machine (MA), so as to transfer the articles (1*a*) to the inlet station (6);

the unit being characterized in that said receiving means (4*a*) include a plurality of hoppers (4*a*) equipped with bottoms (4*b*), which can be opened; said hoppers (4*a*), being movable to said first working configuration (A), where they take positions corresponding and in registry with respective stationary hoppers (3*a*) placed at fixed mutual distances at said outlet station (3), and movable to said second working configuration (B), where they take positions corresponding and in registry with respective stationary hoppers (5*a*) placed at fixed mutual distances and belonging to an operative terminal line (5); said terminal line (5) being situated between said receiving means and said inlet station (6) and the relevant hoppers (5*a*) are so located to match corresponding box-compartments (6*a*) of a box-conveyor (6) of said inlet station.

2. A unit according to claim 1, characterized in that said receiving means (4*a*) are mounted moving on guide means (30), in order to alternatively compress/expand with respect to one another, under the action of motor means.

3. A unit according to claim 1, characterized in that said operative terminal line (5) is mounted on a mobile support (50) in order to be moved at the same speed as said box-conveyor (6) of said inlet station (6) of the packaging machine (MI).

* * * * *